US009437148B2

(12) United States Patent
Koo et al.

(10) Patent No.: US 9,437,148 B2
(45) Date of Patent: Sep. 6, 2016

(54) DISPLAY DEVICE HAVING INTEGRAL CAPACITORS AND REDUCED SIZE

(71) Applicant: Samsung Display Co., Ltd., Yongin, Gyeonggi-Do (KR)

(72) Inventors: Bon-Yong Koo, Cheonan-si (KR); Dong Yeon Son, Asan-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 14/262,414

(22) Filed: Apr. 25, 2014

(65) Prior Publication Data

US 2015/0194112 A1 Jul. 9, 2015

(30) Foreign Application Priority Data

Jan. 7, 2014 (KR) ..... 10-2014-0001804

(51) Int. Cl.
*G09G 3/36* (2006.01)

(52) U.S. Cl.
CPC ..... *G09G 3/3648* (2013.01); *G09G 3/3677* (2013.01); *G09G 2300/0408* (2013.01); *G09G 2310/0286* (2013.01)

(58) Field of Classification Search
None
See application file for complete search history.

(56) References Cited

U.S. PATENT DOCUMENTS

| | | | | |
|---|---|---|---|---|
| 8,223,307 | B2 | 7/2012 | Kim et al. | |
| 2002/0089022 | A1* | 7/2002 | Lutze | 257/410 |
| 2009/0310047 | A1* | 12/2009 | Shin et al. | 349/37 |
| 2010/0134396 | A1 | 6/2010 | Umezaki | |
| 2012/0229712 | A1 | 9/2012 | Yoshida et al. | |
| 2012/0320008 | A1 | 12/2012 | Takahashi et al. | |
| 2013/0039455 | A1 | 2/2013 | Horiuchi et al. | |
| 2013/0101755 | A1* | 4/2013 | Lee et al. | 428/1.23 |
| 2015/0138466 | A1* | 5/2015 | Mori | 349/38 |

FOREIGN PATENT DOCUMENTS

| | | | |
|---|---|---|---|
| KR | 10-2008-0000205 | A | 1/2008 |
| KR | 10-2008-0022245 | A | 3/2008 |
| KR | 10-2011-0043892 | A | 4/2011 |
| KR | 10-2011-0117511 | A | 10/2011 |
| KR | 10-2012-0073495 | A | 7/2012 |

* cited by examiner

*Primary Examiner* — Alexander Eisen
*Assistant Examiner* — Kebede Teshome
(74) *Attorney, Agent, or Firm* — Innovations Counsel LLP

(57) ABSTRACT

The output stage of a monolithically integrated gate lines driver circuit of a display device has a capacitor boosted, source-follower configuration in which a relatively large area transistor (Tr1) receives drive power at its drain from a clock signal providing rail (CK), a source of the transistor drives a respective gate line and a relatively large area boost capacitor (C1) connects to gate and the source of the transistor. In order to reduce consumption of substrate area, the relatively large area boost capacitor is laid out to overlap the transistor while a relatively thick first insulating layer of relatively low dielectric constant positioned between the transistor and the overlying boost capacitor.

18 Claims, 17 Drawing Sheets

DISPLAY DEVICE HAVING INTEGRAL CAPACITORS AND REDUCED SIZE

CROSS-REFERENCE TO RELATED APPLICATION

This application claims priority to and the benefit of Korean Patent Application No. 10-2014-0001804 filed in the Korean Intellectual Property Office on Jan. 7, 2014, the entire contents of which application are incorporated herein by reference.

BACKGROUND (a) Technical Field

The present disclosure of invention relates to a display device, and more particularly, to a display device including a monolithically integrated gate lines driver where each gate line drive circuit includes a capacitor.

(b) Description of Related Technology

A flat or otherwise thin display device generally includes a display panel including a matrix of pixel units and display drive signal lines as well as a gate lines driver circuit configured to transmit gate signals to respective gate lines among the display drive signal lines. The transmitted gate signals are used to turn on/off switching elements found in of the pixel units. Additionally, the display panel typically includes a data lines driver circuit configured to apply respective data voltages to corresponding data lines among the display drive signal lines and a signals timing controller configured to control the timings of the display panel drive signals.

The liquid crystal display (LCD) is a relatively popular type among the various kinds of flat or otherwise thin display devices, and it typically includes two spaced apart panels with electric field generating electrodes provided thereon such as pixel electrodes and a common electrode, where a liquid crystal material layer is interposed between the spaced apart panels. The liquid crystal display generates an electric field through the liquid crystal layer by applying a voltage across the field generating electrodes, and this determines an optical orientation direction of liquid crystal molecules of the liquid crystal layer, thus controlling polarization of incident light so as to form displayable images. Image quality of the liquid crystal display may be improved if the liquid crystal molecules are controlled well.

At least one pixel electrode included in each pixel unit of the liquid crystal display is connected with a corresponding switching element where the latter is connected to a corresponding gate line and a corresponding data line. The switching element may be a three-terminal element such as a thin film transistor (TFT) and it is used to selectively transfer an extant data voltage on the corresponding data line to its respective pixel electrode.

In the liquid crystal display, the pixel electrode and the common electrode generating the electric field in the liquid crystal layer may be provided on one display panel with the switching element. At least one of the pixel electrode and the common electrode of the liquid crystal display may include a plurality of branch electrodes. When the electric field is generated in the liquid crystal layer, alignment directions of the liquid crystal molecules of the liquid crystal layer are determined by a fringe field generated by the branch electrodes.

Line driving circuits such as the gate lines driver and the data lines driver may be mounted on the display device in an IC chip form, or mounted on a flexible printed circuit film to be attached to the display device in a tape carrier package (TCP) form, or mounted on a printed circuit board. However, recently, at least in the case of the gate lines driver which does not require a very fast switching time (does not require a high charge carrier mobility within the channels of its thin film transistors) because the gate line voltage is maintained constant for at least one horizontal scan period (1 H), a structure, in which the gate driver is not formed as a separate chip but rather it is monolithically integrally included on the display panel and formed by the same mass production process as used for forming the display drive signal lines and the switching elements, is being pursued. When the gate lines drive circuitry is so monolithically integrated, it consumes part of the scarce real estate area that is present on the TFT array panel.

The gate lines driver includes at least one shift register configured as a plurality of cascaded stages dependently connected to each other, and a plurality of signal lines transferring appropriate driving signals to the respective stages of the shift register. The plurality of stages includes a plurality of thin film transistors and capacitors. Each stage is connected to the corresponding gate line, and the plurality of stages sequentially output their respective gate signals to respective ones of the gate lines in a predetermined order.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

SUMMARY

In the display device in which the gate driver is monolithically integrated on the display panel, most of an area occupied by the gate driver is a non-display area in which an image is not displayed. Accordingly, as the area occupied by the gate driver is increased, an area of the non-display area of the display panel, particularly, a peripheral area around the display area in which the image is displayed is increased, and as a result, the customers' desires for a display device having a small area of the peripheral area may not be satisfied.

The present disclosure of invention provides a display device having advantages of reducing an area of a peripheral area of the display device by decreasing an area occupied by the gate driver in the display panel.

Further, the present disclosure of invention provides a display device having advantages of preventing a characteristic of a transistor of a gate driver from deteriorating while decreasing the area occupied by the gate driver in the display panel.

An exemplary display device includes: a display panel including a display area in which a plurality of pixels are positioned and a peripheral area around the display area; and a gate driver positioned in the peripheral area and including a transistor and a capacitor, in which the capacitor overlaps the transistor with a first insulating layer being interposed therebetween, the first insulating layer positioned above the transistor.

The first insulating layer may include an organic insulating material.

The capacitor may include a first electrode and a second electrode which overlap each other with a second insulating layer interposed therebetween.

The pixel may include a switching element, a pixel electrode connected with the switching element, and a common electrode transferring a common voltage, the pixel electrode and the common electrode may be positioned above the first insulating layer, and the pixel electrode and the common electrode may overlap each other with the second insulating layer therebetween.

The transistor may include a first gate electrode, a first drain electrode, and a first source electrode, the first electrode of the capacitor may be connected with the first gate electrode, and the second electrode of the capacitor may be connected with the first source electrode.

The first insulating layer may include a first contact hole exposing the first gate electrode and a second contact hole exposing the first source electrode, the first electrode may be connected with the first gate electrode through the first contact hole, and the second electrode may be connected with the first source electrode through the second contact hole.

The display device may further include a gate line transferring a gate signal to the pixel, in which the first insulating layer may further include a third contact hole exposing an end portion of the gate line, and the second electrode may be connected with the end portion of the gate line through the third contact hole.

A thickness of the first insulating layer may be approximately 1.0 μm or more.

A dielectric constant of the first insulating layer may be approximately 10 or less.

The first electrode may be positioned at a same layer as the pixel electrode, and the second electrode may be positioned at a same layer as the common electrode.

The first electrode may be positioned at a same layer as the common electrode, and the second electrode may be positioned at a same layer as the pixel electrode.

One of the pixel electrode and the common electrode may include a plurality of branch electrodes, and the other electrode may overlap the plurality of branch electrodes.

The display device may further include a third insulating layer positioned between the first insulating layer and the transistor.

According to the exemplary embodiment of the present disclosure, it is possible to reduce an area of a peripheral area of the display device by decreasing an area occupied by the gate driver in the display panel of the display device. Further, it is possible to prevent a characteristic of a transistor of a gate driver from deteriorating while decreasing the area occupied by the gate driver in the display panel.

DETAILED DESCRIPTION

Figure 1:
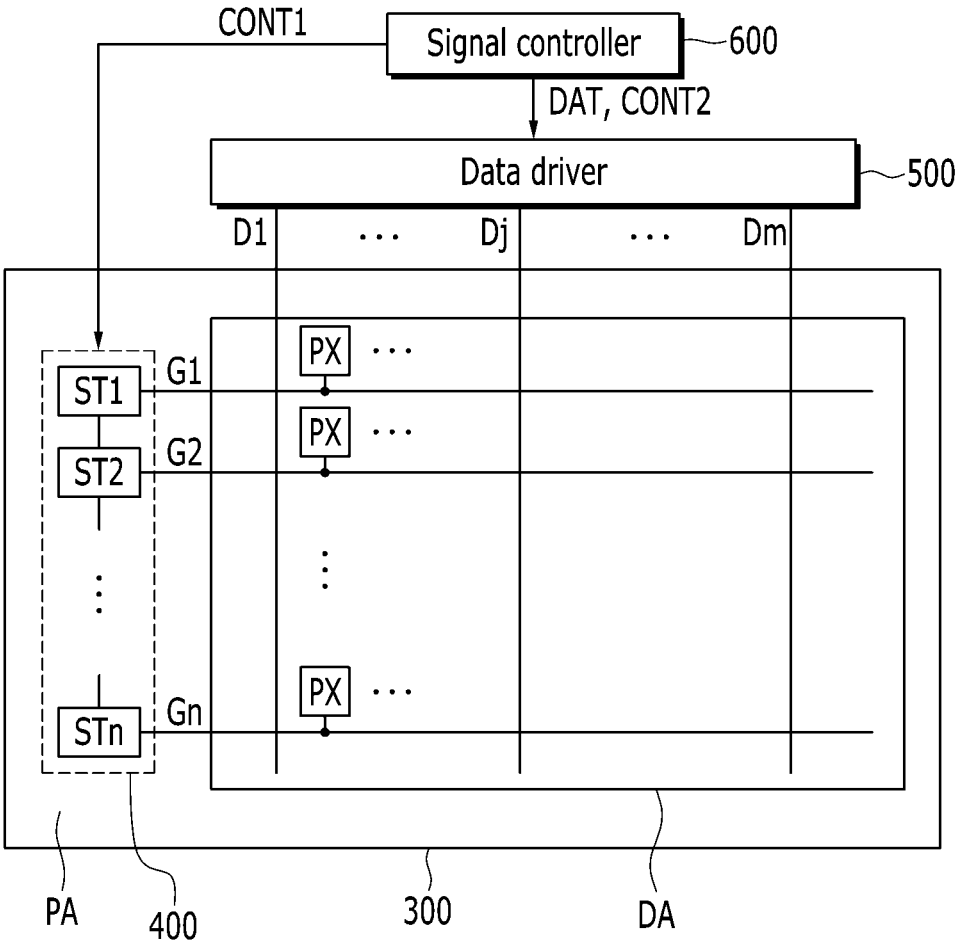
FIG. 1 is a block diagram of a first display device configuration that may be used in accordance with the present disclosure of invention.

The present disclosure of invention will be described more fully hereinafter with reference to the accompanying drawings, in which exemplary embodiments are shown. As those skilled in the art would realize in light of this disclosure, the described embodiments may be modified in various different ways, all without departing from the spirit or scope of the present teachings.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Unless otherwise stated, the TFT transistors described herein are understood to be NMOS transistors, meaning they have a P-type channel region and N-type source and drain regions. It is within the contemplation of the disclosure to apply similar concepts however, to circuitry that is built around PMOS transistor technology or CMOS technology.

First, a display device according to an exemplary embodiment of the present disclosure will be described with reference to FIGS. 1 to 3.

FIG. 1 is a block diagram of a display device according to a first exemplary embodiment in accordance with the present disclosure of invention. FIG. 2 is a schematic circuit diagram of one pixel unit of the display. FIG. 3 is a block diagram of a display device according to another exemplary embodiment.

Referring to FIG. 1, a display device according to a first exemplary embodiment includes a display panel 300, a gate lines driver 400 and a data driver 500, and a signal controller 600.

The display panel 300 may be a display panel included in various display devices such as a liquid crystal display (LCD), an organic light emitting display (OLED), and an electrowetting display (EWD).

The display panel 300 includes a display area DA configured for displaying an image, and a peripheral area PA positioned therearound and not configured for displaying an image.

In the display area DA there are provided, a plurality of gate lines G1-Gn, a plurality of data lines D1-Dm crossing with the gate lines, and a plurality of pixel units PX arranged as a matrix and each connected to respective ones of the plurality of gate lines G1-Gn and of the plurality of data lines D1-Dm.

The gate lines G1-Gn may transfer gate signals, extend substantially in a row direction, and are spaced apart to be substantially parallel to each other.

The data lines D1-Dm may transfer data voltages corresponding to the image signals, extend substantially in a column direction, and are spaced apart to be substantially parallel to each other.

The plurality of pixel units PX may be arranged substantially in a matrix form such as one having a rectangular outline and being internally subdivided into horizontal rows and vertical columns.

Figure 2:
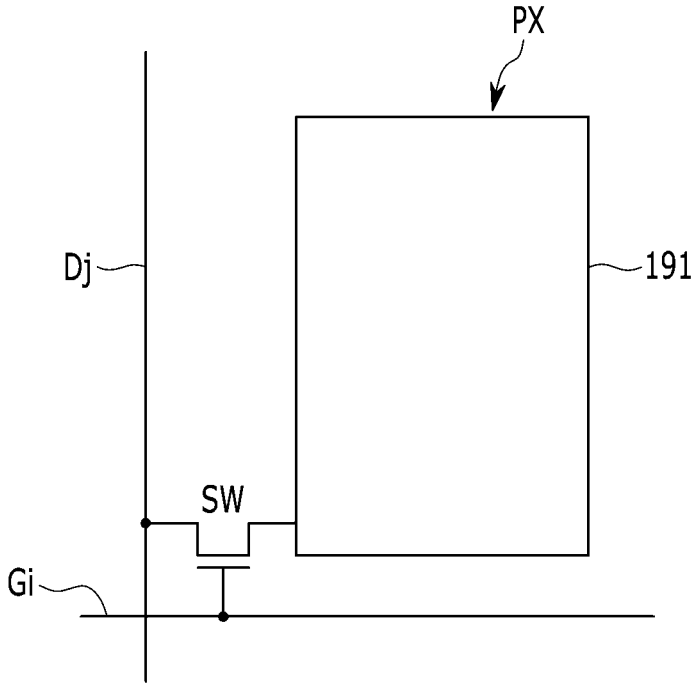
FIG. 2 is a schematic circuit diagram of a representative one pixel unit of the display device of FIG. 2.

Referring to FIG. 2, each pixel unit PX may include at least one switching element SW connected with a corresponding gate line Gi and a corresponding data line Dj, and at least one pixel electrode 191 connected thereto. The switching element SW may be a three-terminal element such as a thin film transistor TFT that is monolithically integrated on a monolithic substrate of the display panel 300. The thin film transistor includes a gate terminal, an input terminal (e.g., source), and an output terminal (e.g., drain). The switching element SW may be turned on or off according to a gate signal of the corresponding gate line Gi to transfer a data signal from the data line Dj to the pixel electrode 191. The switching element SW may include at least one thin film transistor. The pixel unit PX may display a corresponding pixel of an image having plural pixels and according to the data voltage applied to the pixel electrode 191.

The peripheral area PA is a part of the non-display area which is an area in which the image is not displayed in the display device and one to be covered by a light blocking member. The peripheral area PA may surround the display area DA or be positioned at an edge of the display area DA.

In the peripheral area PA, the gate lines driver 400 and a plurality of signal wires (not illustrated) arranged for transferring driving signals to the gate lines driver 400 may be positioned. The gate lines G1-Gn and the data lines D1-Dm of the display area DA may be extended into the peripheral area PA.

The signal controller 600 controls drivers such as the data lines driver 500 and the gate lines driver 400.

The signal controller 600 receives input image signals and input control signals for controlling the display of the input image signals from an external graphic controller (not illustrated). An example of the input control signals includes a vertical synchronization signal, a horizontal synchronization signal, a main clock signal, a data enable signal, and the like. The signal controller 600 properly processes the input image signals based on the input image signal and the input control signals to accordingly convert the input image signal into a digital image signal DAT, and to generate a gate drive control signal CONT1, a data drive control signal CONT2, and the like. The gate drive control signal CONT1 includes a scanning start signal STV instructing scanning start, at least one clock signal controlling an output period of a gate-on voltage Von, at least one low voltage, and the like. The data drive control signal CONT2 includes a horizontal synchronization start signal informing transmission start of the digital image signal DAT for pixels PX in one row, a load signal, a data clock signal, and the like.

The signal controller 600 may transfer the data control signal CONT2, the gate control signal CONT1, the digital image signal DAT, and the like respectively to the gate lines driver 400 and the data lines driver 500.

The data lines driver 500 is connected to the data lines D1-Dm of the display panel 300. The data lines driver 500 receives the data control signal CONT2 and the digital image signal DAT from the signal controller 600 and selects respective gray scale analog voltages corresponding to each digital image signal DAT to thereby convert the digital image signal DAT into an analog data signal, and then apply the converted analog data signal to the corresponding ones of the data lines D1-Dm.

The data lines driver 500 may be directly mounted on the peripheral area PA of the display panel 300 in a form of a plurality of IC chips, or mounted externally on a flexible printed circuit film to be attached to the display device in a tape carrier package (TCP) form, or mounted on an external printed circuit board. According to another exemplary embodiment, the data lines driver 500 may be monolithically integrated within the peripheral area PA of the display panel 300 by use of a same fabrication process as used for forming the monolithically integrated electric elements such as the thin film transistors of the display area DA.

The gate lines driver 400 is connected to the gate lines G1-Gn. The gate lines driver 400 generates respective gate signals each having a gate-on voltage level Von for a time (e.g., a period of 1 H) and a gate-off voltage level Voff for another stretch of time (e.g., frame period minus 1 H) as controlled by the gate control signal CONT1 provided from the signal controller 600. The gate lines driver 400 responsively applies the respective gate signals to the corresponding gate lines G1-Gn accordingly. The gate-on voltage level Von is a voltage which is applied to the gate terminal of the thin film transistor in the display area DA to turn on the thin film transistor, and the gate-off voltage level Voff is a voltage which is applied to the gate terminal of the thin film transistor to turn off the thin film transistor (render it essentially nonconductive).

Referring to FIG. 1, the gate lines driver 400 according to the illustrated exemplary embodiment is integrated at one side in the peripheral area PA of the display panel 300. The gate driver 400 may include a plurality of stages ST1-STn dependently connected to each other and sequentially arranged.

The plurality of stages ST1-STn is dependently connected to each other. The plurality of stages ST1-STn generates gate signals that sequentially activate the respective gate lines G1-Gn one after the next. Each of the stages ST1-STn includes a gate line driving circuit connected to a corresponding one of the gate lines G1-Gn, and it may have a gate output terminal (not illustrated) outputting a gate signal.

The stages ST1-STn of the gate driver 400 may be positioned in the peripheral area PA at the left or the right of the display area DA, and arranged in a column direction in a line. In FIG. 1, an example in which the plurality of stages ST1-STn is positioned in the peripheral area PA positioned at the left of the display area DA is illustrated, but is not limited thereto, and the plurality of stages ST1-STn may be positioned at least one of the peripheral areas PA at the right, the upper side, or the lower side based on the display area DA.

According to an exemplary embodiment of the present disclosure, each of the stages ST1-STn may be connected with output terminals of previous stages ST1-STn or subsequent stages ST1-STn. A first stage ST1 without the previous stage may receive a scanning start signal STV notifying it of a commanded start of one frame. The last stage STn without a subsequent stage may be coupled in a different way (e.g., to a dummy next stage) instead of being connected to a subsequent and operative stage.

Each of the stages ST1-STn may include a plurality of thin film transistors and at least one capacitor integrated in the peripheral area PA of the display panel 300. The thin film transistor and the capacitor (boost capacitor) included in the gate driver lines 400 may be manufactured by using the same fabrication process as used for the thin film transistors and the like included in the pixel units PX of the display area DA.

Figure 3:
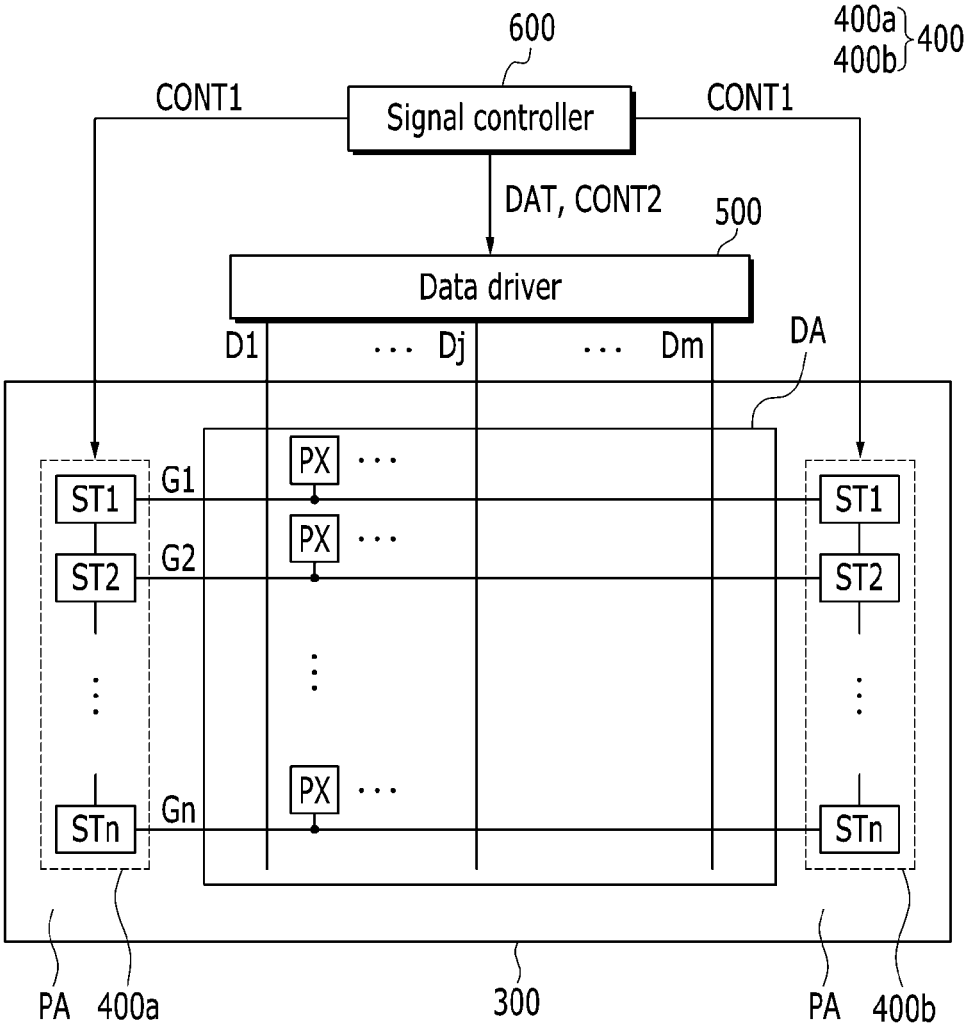
FIG. 3 is a block diagram of a second display device configuration that may be used in accordance with the present disclosure of invention.

Referring to FIG. 3, the display device according to the other exemplary embodiment is almost the same as the display device illustrated in FIGS. 1 and 2 described above, but the gate driver 400 may include a first gate driver 400*a* and a second gate driver 400*b* which are positioned in the peripheral areas PA at the left and right side of the display panel 300, respectively. The first gate driver 400*a* and the second gate driver 400*b* are not illustrated, but may receive driving signals such as the gate control signal CONT1 through each signal wire.

Each of the first lines gate driver 400*a* and the second gate lines driver 400*b* includes the plurality of stages ST1-STn arranged in a column direction in a line. The corresponding stages of the first gate driver 400*a* and the second gate driver 400*b* may be connected to the same gate lines G1-Gn as illustrated in FIG. 3 to apply the gate signals, or connected to different gate lines G1-Gn to apply the gate signals. For example, the first gate driver 400*a* may be connected to odd numbered gate lines G1, G3, . . . , and the second gate driver 400*b* may be connected to even numbered gate lines G2, G4, . . . , and may have a connection relationship opposite thereto.

Next, an example of a structure of the gate lines driver according to an exemplary embodiment will be described with reference to FIG. 4.

Figure 4:
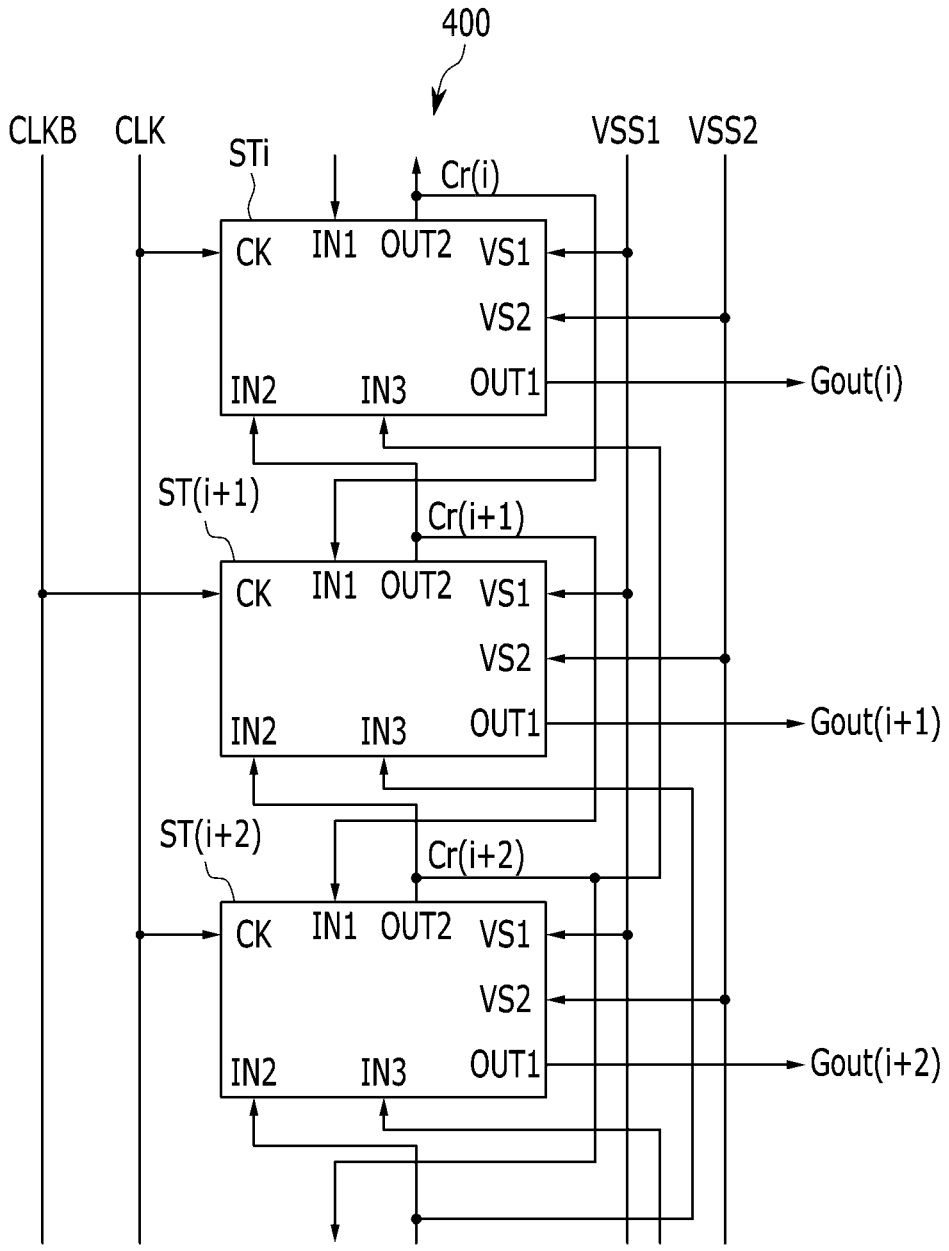
FIG. 4 is a block diagram of a portion of a gate lines driver circuit formed according to an exemplary embodiment of the present disclosure.

FIG. 4 is a block diagram of a gate lines driver according to the exemplary embodiment of the present disclosure of invention.

Referring to FIG. 4, any one of gate lines drivers 400, 400*a*, and 400*b* according to the above mentioned exemplary embodiments may include a plurality of cascade-wise interconnected stages ST1, . . . , STi, ST(i+1), ST(i+2), . . . , which are dependently connected one to the next and which sequentially output line-activating (turning on) gate signals Gout1, . . . , Gout(i), Gout(i+1), Gout(i+2), . . . , Gout(n). The illustrated portion of the gate lines driver of FIG. 4 includes a plurality of signal wires transferring various driving signals CLK, CLKB, VSS1, VSS2, and STV inputted to the stages ST1, . . . , STi, ST(i+1), ST(i+2), . . . . Here, the signal wires will be represented with the same reference numerals as the driving signals CLK, CLKB, VSS1, and VSS2 transferred by the signal wires, respectively.

The plurality of signal wires may include, for example, clock signal wires CLK and CLKB transferring differently phased clock signals CLK and CLKB, first and second voltage wires VSS1 and VSS2 transferring the first low voltage VSS1 and the second low voltage VSS2, a scanning start signal wire (not illustrated) transferring the scanning start signal STV, and the like.

Each of the stages ST1, . . . , STi, ST(i+1), ST(i+2), . . . may include a clock terminal CK, a first low voltage input terminal VS1, a second low voltage input terminal VS2, a first output terminal OUT1, a second output terminal OUT2, a first input terminal IN1, a second input terminal IN2, and a third input terminal IN3.

One of the clock signal CLK and the clock signal CLKB may be selectively input to the clock terminal CK of each of the stages ST1, . . . , STi, ST(i+1), ST(i+2), . . . . For example, the clock signals CLK may be applied to the clock terminals CK of the odd numbered stages ST1, ST3, . . . , and the clock signals CLKB may be applied to the clock terminals CK of the even numbered stages ST2, ST4, . . . . In this case, a phase of the clock signal CLKB may be opposite to a phase of the clock signal CLK.

The first low voltage VSS1 and the second low voltage VSS2 which are low voltages with different magnitudes and are input to the first low voltage input terminal VS1 and the second low voltage input terminal VS2, respectively. According to an exemplary embodiment, the second low voltage VSS2 may be more negative than the first low voltage VSS1. Values of the first low voltage VSS1 and the second low voltage VSS2 may vary in some cases, and be approximately −5V or less. The first low voltage VSS1 may be, for example, approximately −5.6 V, and the second low voltage VSS2 may be, for example, approximately −9.2 V.

The first output terminal OUT1 is a gate output terminal outputting the gate signals Gout1, . . . , Gout(i), Gout(i+1), Gout(i+2), . . . generated by the stages ST1, . . . , STi, ST(i+1), ST(i+2), . . . , respectively. The second output terminal OUT2 is a carry output terminal outputting carry signals Cr1, . . . , Cr(i), Cr(i+1), Cr(i+2), . . . generated by the stages ST1, . . . , STi, ST(i+1), ST(i+2), . . . , respectively.

The first input terminal IN1 may receive carry signals Cr1, . . . , Cr(i), Cr(i+1), Cr(i+2), . . . of the previous stage. In the case of the first stage ST1 without a previous stage, the scanning start signal STV may be input to its first input terminal IN1.

The carry signals Cr1, . . . , Cr(i), Cr(i+1), Cr(i+2), . . . of the subsequent stage, particularly, the carry signals Cr1, . . . , Cr(i), Cr(i+1), Cr(i+2), . . . of the directly next stage may be input to the second input terminal IN2.

The carry signals Cr1, . . . , Cr(i), Cr(i+1), Cr(i+2), . . . of the subsequent stage, particularly, the carry signals Cr1, . . . , Cr(i), Cr(i+1), Cr(i+2), . . . of a stage after two stages may be input to the third input terminal IN3.

Next, an example of a detailed structure of each stage of the gate driver illustrated in FIG. 4 described above will be described with reference to FIG. 5.

Figure 5:
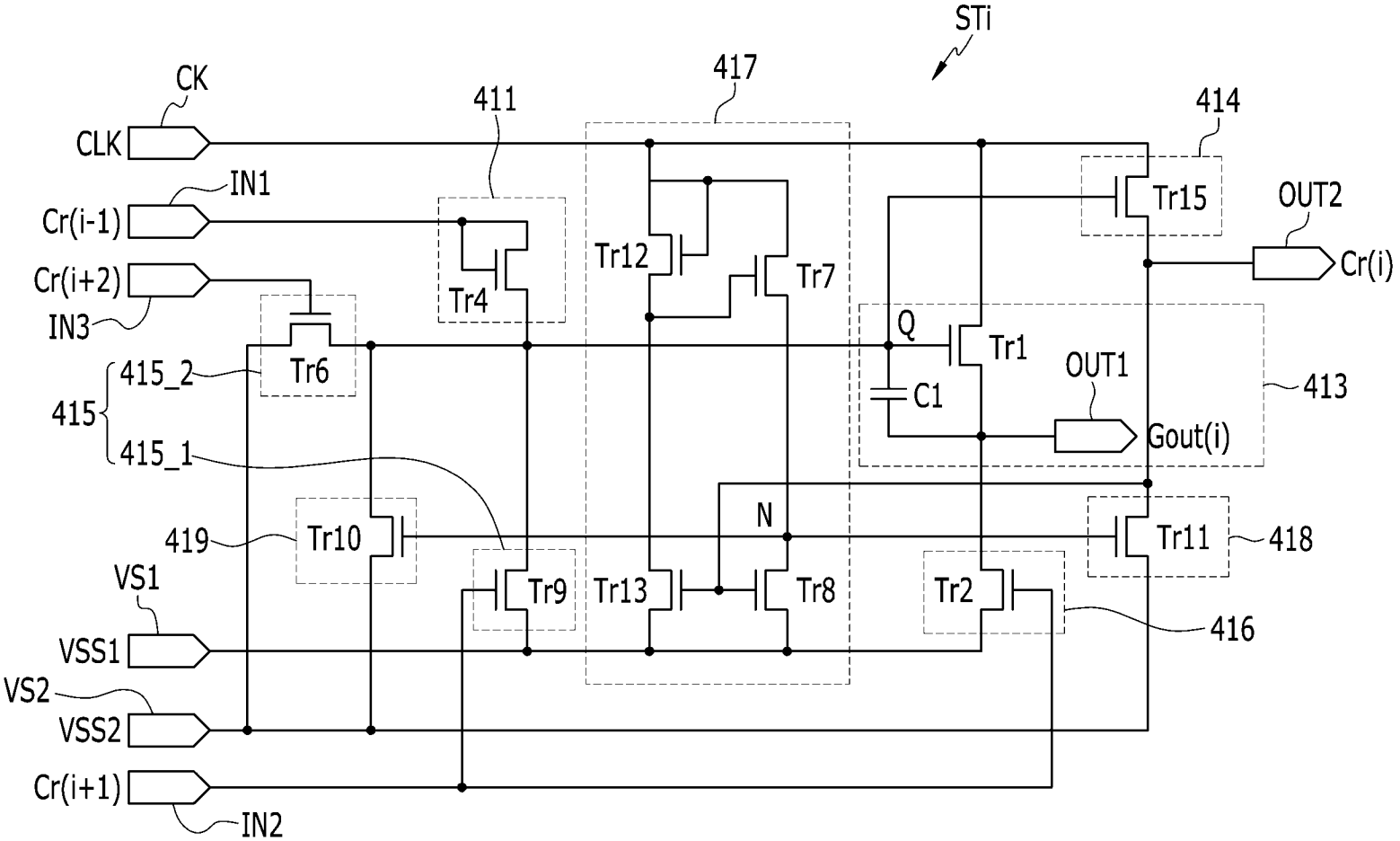
FIG. 5 is an example of a circuit diagram of one stage of the gate lines driver according to the present disclosure where the stage includes a so-called, boost capacitor (C1).

FIG. 5 illustrates an example of the circuit diagram of one stage, for example, an i-th stage STi of the gate driver according to the exemplary embodiment of the present disclosure of invention.

The stage STi according to the exemplary embodiment of the present invention includes a plurality of transistors Tr1, Tr2, Tr4, Tr6, Tr7, Tr8, Tr9, Tr10, Tr11, Tr12, Tr13, and Tr15 and at least one capacitor C1 (boost capacitor) in addition to the clock terminal CK, the first low voltage input terminal VS1, the second low voltage input terminal VS2, the first output terminal OUT1, the second output terminal OUT2, the first input terminal IN1, the second input terminal IN2, and the third input terminal IN3 as described above. FIG. 5 illustrates 12 transistors, but the number of transistors in alternate embodiments is not limited thereto.

The plurality of transistors and capacitors included in the stage STi may be subdivided so as to define a buffer portion 411, a pull-up portion 413, a carry portion 414, a discharge portion 415, a pull-down portion 416, a switching portion 417, a first storage portion 418, and a second storage portion 419, according to respective functions.

The buffer portion 411 transfers a carry signal of one stage among the previous stages or a scanning start signal to the pull-up portion 413. The buffer portion 411 may receive, for example, a carry signal Cr(i−1) of the previous stage ST(i−1). In the exemplary embodiment, it is described that the buffer portion 411 transfers the carry signal Cr(i−1) of the previous stage ST(i−1), but is not limited thereto.

The buffer portion 411 may include a fourth transistor Tr4. An input terminal and a control terminal of the fourth transistor Tr4 are common-connected (diode-connected) to the first input terminal IN1, and an output terminal is connected to a node Q. When the carry signal Cr(i−1) input to the first input terminal IN1 is at a high level, the fourth transistor Tr4 connects the input terminal and the output terminal with each other to output the high level voltage as it is, and when the carry signal Cr(i−1) is at a low level, the fourth transistor Tr4 separates the input terminal and the output terminal from each other.

The pull-up portion 413 is connected with the clock terminal CK, the internal node Q, and the first output terminal OUT1, and outputs a gate signal Gout(i) through the first output terminal OUT1.

The pull-up portion 413 may include, for example, a first transistor Tr1 and a capacitor C1 (boost capacitor) connected thereto and to the Q node line. The control terminal of the first transistor Tr1 is connected to the node Q, the input terminal is connected with the clock terminal CK, and the output terminal is connected with the first output terminal OUT1. The capacitor C1 is connected between the control terminal and the output terminal of the first transistor Tr1. The capacitor C1 is charged in response to the carry signal Cr(i−1) provided by the buffer portion 411. When the clock signals CLK or CLKB from the clock terminal CK are at the high voltages while the voltage of the node Q is at the high level according to the charge of the capacitor C1, the turning on of the first transistor Tr1 is bootstrapped by the rising voltage at its gate. More specifically, the node Q is boosted in voltage due to a precharging voltage applied to the capacitor C1 and then as the source node rises to higher level due to Tr1 having been turned on, the gate of Tr1 is lifted to a boosted voltage level which is the sum of the voltage across capacitor C1 and the voltage of the source terminal of first transistor Tr1. In other words, when the boosted voltage is applied to the control (gate) terminal of the first transistor Tr1, the first transistor Tr1 is switched into a more highly conductive state (e.g., a saturated on state) and it outputs the high voltage of the respective clock signal CLK or CLKB as a gate-on voltage Von through the first output terminal OUT1 with minimal voltage drop (Vds and Rds are minimized). When the voltage of the node Q drops to the low level, the first transistor Tr1 is turned off, and the low voltage may be output from the first output terminal OUT1 by action for example of the pull-down portion 416.

More specifically, the pull-down portion 416 pulls-down the voltage of the gate signal Gout(i) output to the first output terminal OUT1 to the first low voltage VSS1 applied to the first low voltage input terminal VS1 when the carry signal of one stage among the subsequent stages is received in the second input terminal IN2. For example, a carry signal Cr(i+1) of the next stage ST(i+1) may be received in the second input terminal IN2. In the exemplary embodiment, it is described that the pull-down portion 416 receives the carry signal Cr(i+1) of the next stage ST(i+1), but is not limited thereto.

The pull-down portion 416 may include the second transistor Tr2. A control terminal of the second transistor Tr2 is connected with the second input terminal IN2, an input terminal is connected with the first low voltage input terminal VS1, and an output terminal is connected with the first output terminal OUT1.

The carry portion 414 is connected with the clock terminal CK, the node Q, and the second output terminal OUT2, and outputs a carry signal Cr(i) through the second output terminal OUT2. The carry portion 414 outputs the high voltage of the appropriate one of clock signals CLK and CLKB received in the clock terminal CK as the carry signal Cr(i) when the high voltage is applied to the node Q.

The carry portion 414 may include the fifteenth transistor Tr15. The clock terminal CK is connected to an input terminal of the fifteenth transistor Tr15, a control terminal is connected to the node Q, and an output terminal is connected with the second output terminal OUT2.

The first storage portion 418 stores the voltage of the carry signal Cr(i) output to the second output terminal OUT2 at the second low voltage VSS2 in response to the signal of the node N for a period other than the output period of the high voltage of the carry signal Cr(i).

The first storage portion 418 may include the eleventh transistor Tr11. A control terminal of the eleventh transistor Tr11 is connected with the node N, an input terminal is connected with the second low voltage input terminal VS2, and an output terminal is connected with the second output terminal OUT2. The eleventh transistor Tr11 stores the voltage of the carry signal Cr(i) at the second low voltage VSS2 when the voltage of the node N is at a high level.

The switching portion 417 applies a signal having the same phase as the clock signal CLK or CLKB received in the clock terminal CK, to the node N for a period other than the output period of the high voltage of the carry signal Cr(i). The switching portion 417 may include a twelfth transistor Tr12, a seventh transistor Tr7, a thirteenth transistor Tr13, and an eighth transistor Tr8.

The discharge portion 415 can discharge the high voltage of the node Q by way of two different paths, namely, one where Tr6 is turned on, and the discharge is to the second low voltage VSS2 having a lower level than the first low voltage VSS1 in response to the carry signal of at least one stage among the subsequent stages.

The discharge portion 415 may include a first discharge portion 415_1 including a ninth transistor Tr9, and a second discharge portion 415_2 including a sixth transistor Tr6.

The first discharge portion 415_1 discharges the voltage of the node Q to the first low voltage VSS1 applied to the first low voltage input terminal VS1 when the carry signal Cr(i+1) is received from the second input terminal IN2.

The second discharge portion 415_2 discharges the voltage of the node Q to the second low voltage VSS2 applied to the second low voltage input terminal VS2 when the carry signal is applied to the third input terminal IN3. For example, the carry signal Cr(i+2) of the stage ST(i+2) after two stages may be received in the third input terminal IN3.

The second storage portion 419 stores the voltage of the node Q at the second low voltage VSS2 in response to the signal of the node N for the remaining period of the frame. The second storage portion 419 may include a tenth transistor Tr10.

The structure of the stage STi of the gate driver 400 illustrated in FIG. 5 is merely an example, and the internal structure of the stage STi may be varied according to various other similar embodiments which include the boost capacitor C1.

Next, a structure of a pixel unit of a display device according to an exemplary embodiment of the present invention will be described with reference to FIGS. 6 to 8.

Figure 6:
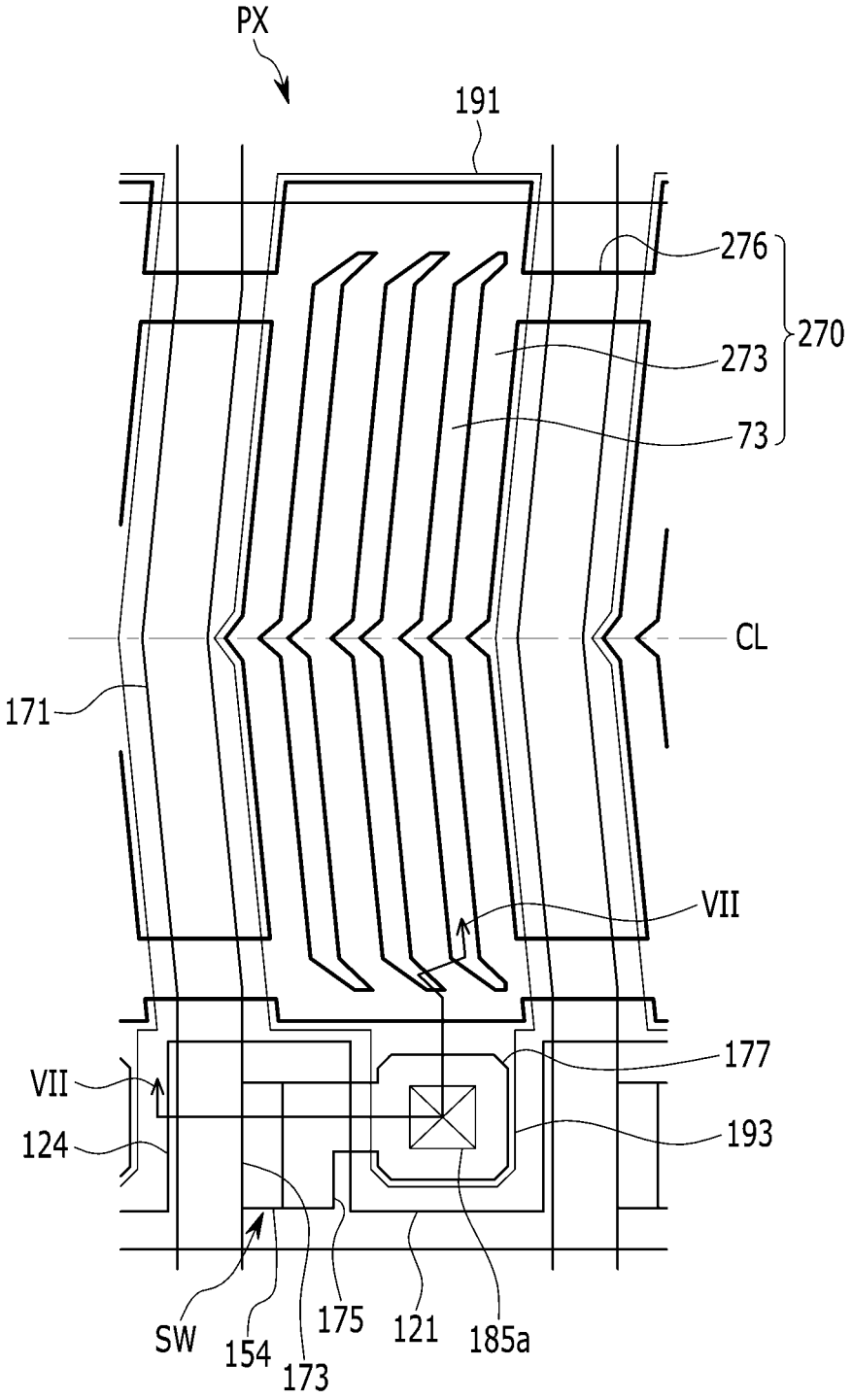
FIG. 6 is a layout view of one pixel unit of a display device according to an exemplary embodiment.

FIG. 6 is a layout view of one representative pixel unit of a display device according to an exemplary embodiment. FIG. 7 is a cross-sectional view of the display device of FIG. 6 taken along line VII-VII, and FIG. 8 is an example of an alternate cross-sectional view of the display device of FIG. 6 taken along line VII-VII.

Figure 7:
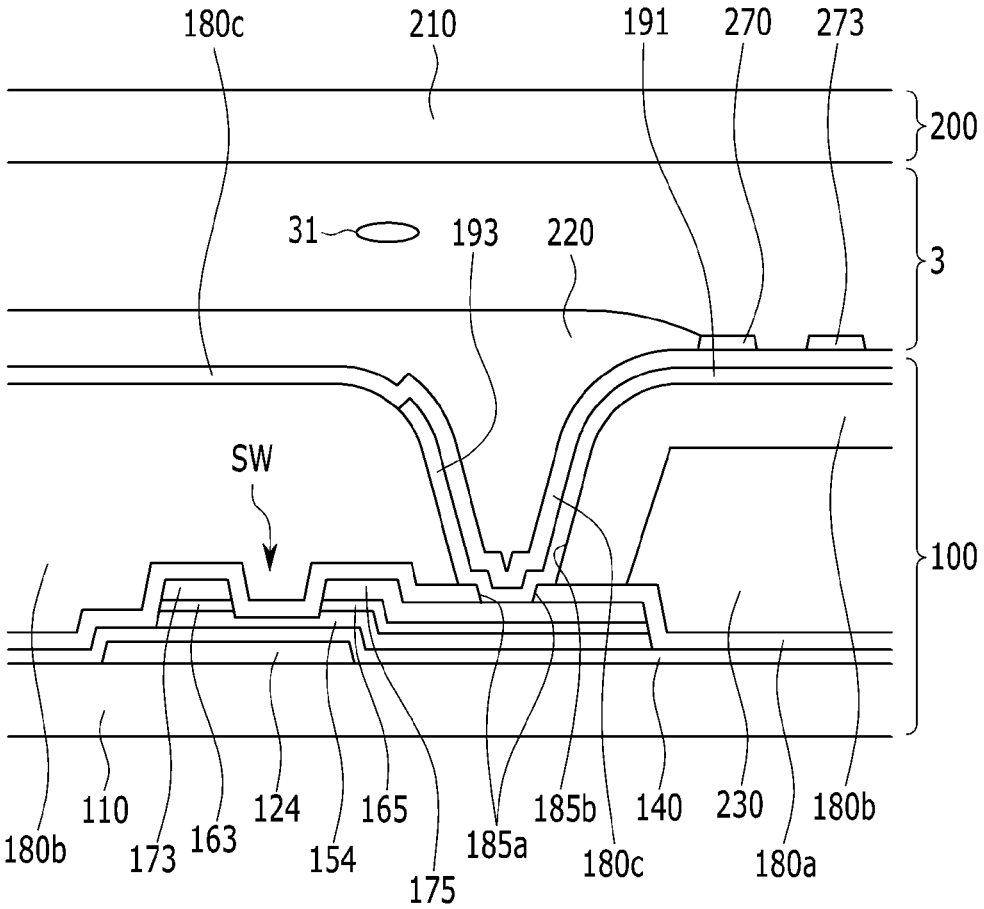
FIG. 7 is a cross-sectional view of the display device of FIG. 6 taken along line VII-VII.
Figure 8:
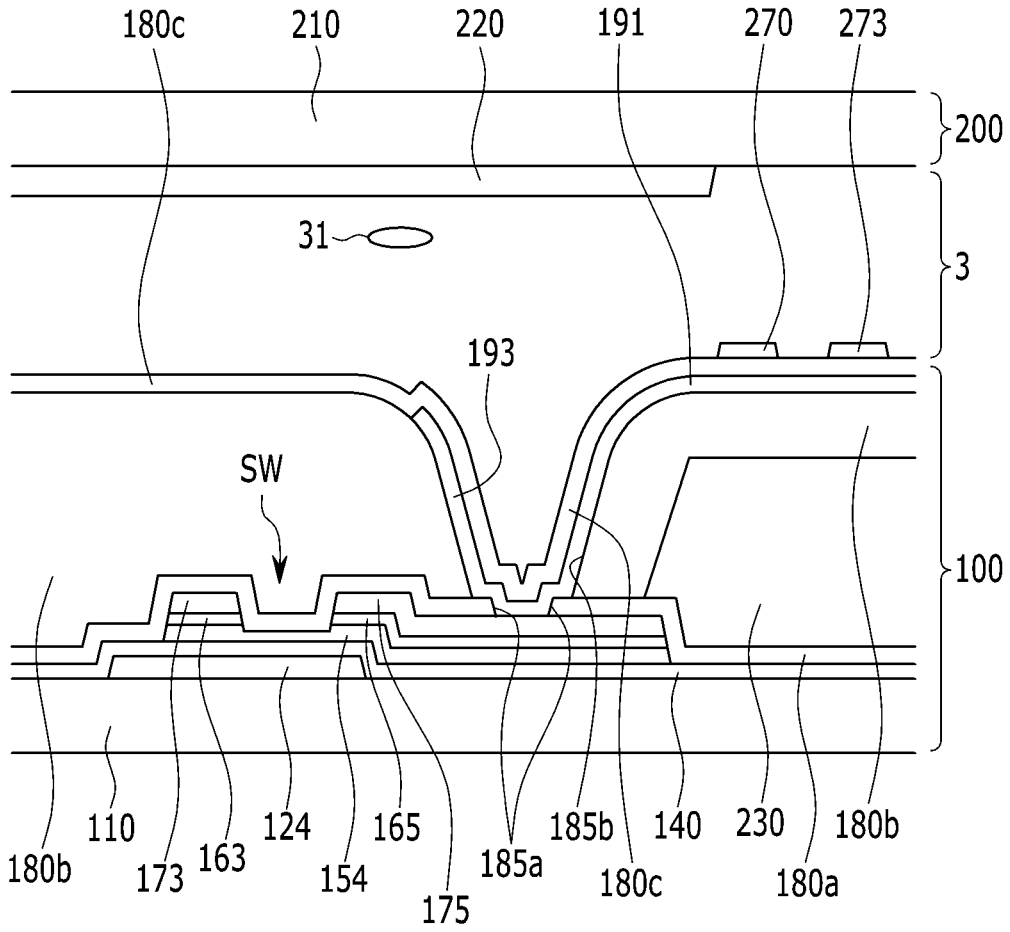
FIG. 8 is an example of a possible other cross-sectional view of a display device such as that of FIG. when 6 taken along line VII-VII.

Referring to FIGS. 6 to 8, the display device according to the exemplary embodiments, as a liquid crystal display, includes a lower panel 100 and an upper panel 200 facing each other, and a liquid crystal layer 3 interposed therebetween.

The upper panel 200 includes an insulation substrate 210 made of a transparent glass and/or plastic.

The liquid crystal layer 3 includes liquid crystal molecules 31 having dielectric anisotropy. The liquid crystal molecules 31 may be aligned so that long axes thereof are parallel or vertical to the panels 100 and 200 without applying an electric field in the liquid crystal layer 3. The liquid crystal molecules 31 may be nematic liquid crystal molecules having a structure in which the long-axial directions thereof are spirally twisted from the lower panel 100 to the upper panel 200.

When describing the lower panel 100, a gate conductor including a plurality of gate lines 121 is positioned on the insulation substrate 110 made of transparent glass, plastic, or the like.

Each gate line 121 may transfer a corresponding gate signal and may mainly extend in a horizontal direction. The gate line 121 includes a gate electrode 124 branching therefrom.

The gate conductor may be made of an aluminum-based metal such as aluminum (Al) or an aluminum alloy, a silver-based metal such as silver (Ag) or a silver alloy, a copper-based metal such as copper (Cu) or a copper alloy, a molybdenum-based metal such as molybdenum (Mo) or a molybdenum alloy, chromium (Cr), tantalum (Ta), and titanium (Ti). The gate conductor may have a multi-layered structure composed of layers of different conductive materials.

A gate insulating layer 140 made of a silicon nitride (SiNx), a silicon oxide (SiOx), or the like (SiOxNy) is formed on the gate conductor.

A semiconductive layer 154 is positioned on the gate insulating layer 140. The semiconductive layer 154 may include amorphous silicon, polysilicon, or a semiconductive oxide.

Ohmic contacts 163 and 165 may be positioned on the semiconductive portion 154. The ohmic contacts 163 and 165 may be made of a material such as n+ hydrogenated amorphous silicon in which n-type impurity such as phosphorus is doped at high concentration or silicide. In the case where the semiconductive portion 154 is the semiconductive oxide, the ohmic contacts 163 and 165 may be omitted.

A data conductor including a data line 171 including a source electrode 173 and a drain electrode 175 is positioned on the ohmic contacts 163 and 165 and the gate insulating layer 140.

The data line 171 may transfer a data signal and may mainly extend in a vertical direction to cross the gate line 121.

The data line 171 may be periodically curved. For example, as illustrated in FIG. 6, each data line 171 may be curved at least one time at a portion corresponding to a horizontal center line CL of the illustrated one pixel unit PX.

The data line 171 includes a source electrode 173. According to the exemplary embodiment illustrated in FIG. 6, the source electrode 173 may be positioned on the same line as the data line 171 without protruding from the data line 171.

The drain electrode 175 faces but is spaced apart from the source electrode 173. The drain electrode 175 may include a rod-shaped portion extending substantially in parallel with the source electrode 173, and an extension 177 which is opposite to the rod-shaped portion.

The data conductor may be made of a refractory metal such as molybdenum, chromium, tantalum, and titanium or an alloy thereof, and may have a multilayered structure including a refractory metal layer (not illustrated) and a low resistive conductive layer (not illustrated).

The gate electrode 124, the source electrode 173, and the drain electrode 175 form one thin film transistor (TFT) SW together with the semiconductive portion 154.

A first passivation layer 180*a* is positioned on the data conductor, the gate insulating layer 140, and an exposed portion of the semiconductive portion 154. The first passivation layer 180*a* may be made of an organic insulating material or an inorganic insulating material. The first passivation layer 180*a* includes a part of the drain electrode 175, for example, a contact hole 185*a* exposing the extension 177.

A color filter 230 may be positioned on the first passivation layer 180*a*. The color filter 230 may uniquely display one of predetermined primary colors, and an example of the primary colors may include three primary colors of red, green, and blue, three primary colors of yellow, cyan, and magenta, or four primary colors. According to another exemplary embodiment, the color filter 230 may further include a color filter displaying a mixed color of the primary colors or white in addition to the primary colors. Each color filter 230 may be formed to elongate along a pixel column or a pixel row.

The color filter 230 may be positioned on the upper panel 200.

A second passivation layer 180*b* is positioned on the color filter 230. The second passivation layer 180*b* may be made of an organic insulating material or an inorganic insulating material. The second passivation layer 180*b* prevents leached of materials from the color filter 230. In other words, it acts as an overcoat for the color filter 230 to prevent an impurity such as a pigment of the color filter 230 from flowing into the liquid crystal layer 3 and it provides a flat (planarized) surface.

When the second passivation layer 180*b* includes an organic insulating material, a thickness of the second passivation layer 180*b* may be approximately 1.0 μm or more, and more particularly, approximately 2.0 μm or more, but is not limited thereto. Further, a dielectric constant of the second passivation layer 180*b* may be approximately 10 or less, and more particularly, approximately 3.3 or less, but is not limited thereto.

The second passivation layer 180*b* may include an opening 185*b* corresponding to the contact hole 185*a* of the first passivation layer 180*a*. An edge of the opening 185*b* may surround an edge of the contact hole 185*a* as illustrated in FIG. 7 or 8, and may substantially coincide with the edge of the contact hole 185*a*.

A pixel electrode 191 may be positioned on the second passivation layer 180*b*. The pixel electrode 191 of each pixel PX may have a mostly planar shape. The pixel electrode 191 may include a protrusion 193 for connection with other layers. The protrusion 193 of the pixel electrode 191 is physically and electrically connected to the drain electrode 175 through the drain contact hole 185*a* to receive a voltage from the drain electrode 175.

The pixel electrode 191 may be made of a conductive material such as a transparent conductive material like ITO or IZO.

A third passivation layer 180*c* is positioned on the pixel electrode 191. The third passivation layer 180*c* may include an organic insulating material or an inorganic insulating material. The third passivation layer 180*c* may define a dielectric layer of the boost capacitor (C1) as shall be described herein.

A branches of a common electrode 270 are positioned on the third passivation layer 180*c*. The common electrode branches 270 are positioned in the plurality of pixels PX and are connected to each other through a connection bridge 276 and the like to transfer substantially the same common voltage Vcom. The common electrode 270 according to the exemplary embodiment may include a plurality of branch electrodes 273 overlapping the pixel electrode 191 having the planar shape. A slit 73 in which an electrode is removed is formed between the adjacent branch electrodes 273.

The pixel electrode 191 receiving the data voltage through the thin film transistor SW and the common electrode 270 receiving the common voltage Vcom generate an electric field extending into the liquid crystal layer 3 together as two field generating electrodes to determine directions of the liquid crystal molecules 31 of the liquid crystal layer 3 and display an image. Particularly, the branch electrodes 273 of the common electrode 270 generate a fringe field in the liquid crystal layer 3 together with the underlying pixel electrode 191 to thereby determine alignment directions of the local liquid crystal molecules 31. The liquid crystal display according to the exemplary embodiment of the present invention may further include at least one polarizer, and may operate in a normally black mode or a normally white mode according to a polarization axial direction of the polarizer.

The common electrode 270 may be made of a conductive material such as a transparent conductive material of ITO or IZO.

A light blocking member 220 may be positioned on the common electrode 270. The light blocking member 220 is also called a black matrix and blocks light leakage through uncontrolled areas disposed between the pixel units. The light blocking member 220 may include a pigment such as black carbon, and include a photosensitive organic material.

Referring FIG. 8, the light blocking member 220 may be positioned on the upper panel 200. In this case, the color filter 230 may also be positioned on the upper panel 200.

According to another exemplary embodiment, a laminating (stacking) position of the pixel electrode 191 and the common electrode 270 may be changed (swapped).

The display device will be described with reference to FIGS. 9 to 11 in addition to the drawings described above.

Figure 9:
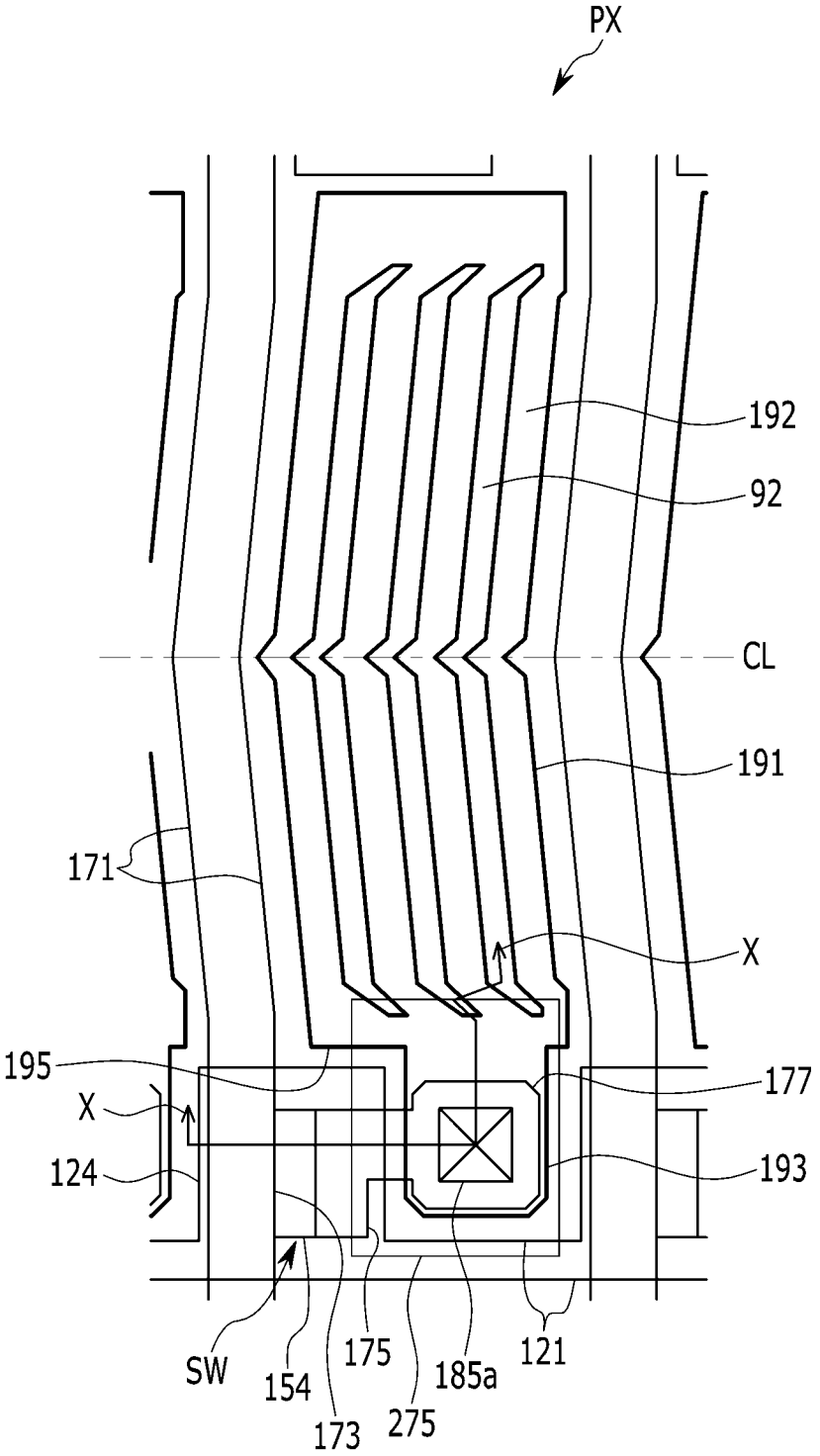
FIG. 9 is a layout view of one pixel unit of a display device according to another exemplary embodiment.

FIG. 9 is a layout view of one pixel unit of a display device according to an exemplary embodiment. FIG. 10 is a cross-sectional view of the display device of FIG. 9 taken along line X-X, and FIG. 11 is another example of the cross-sectional view of the display device of FIG. 9 taken along line X-X.

Figure 10:
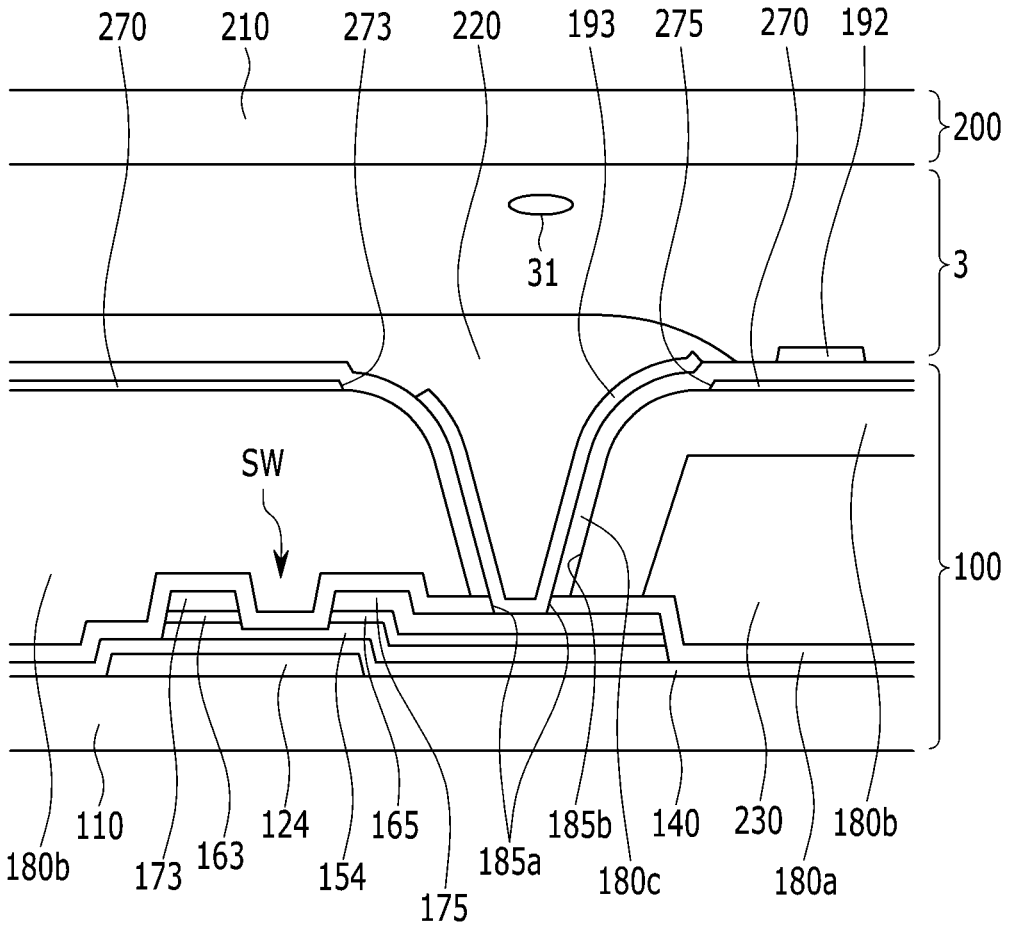
FIG. 10 is a cross-sectional view of the display device of FIG. 9 taken along line X-X.
Figure 11:
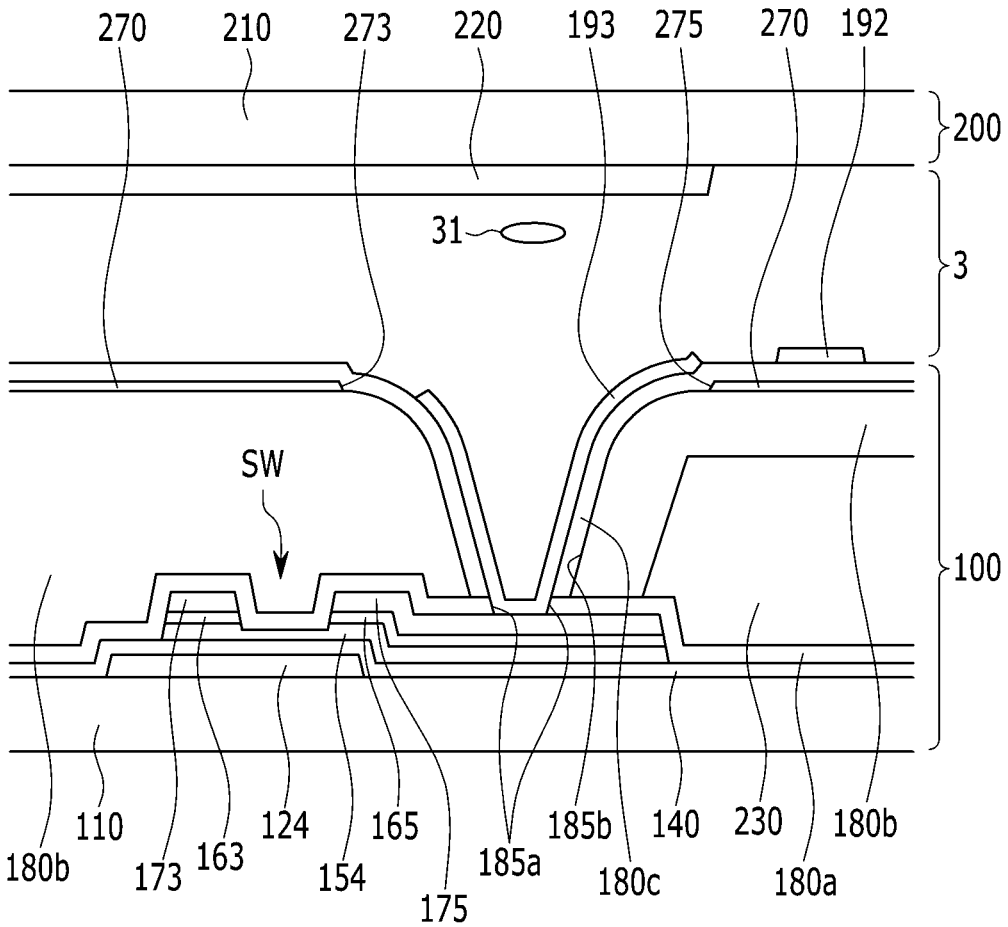
FIG. 11 is an example of a possible other cross-sectional view of a display device such as that of FIG. 9 taken along line X-X.

Referring to FIGS. 9 to 11, the liquid crystal display according to the exemplary embodiment is almost the same as the exemplary embodiment illustrated in FIGS. 6 to 8 described above, but a laminating position of the pixel electrode 191 and the common electrode 270 may be changed. Differences from the above exemplary embodiment will be mainly described.

The common electrode 270 may be positioned on the second passivation layer 180*b*. The common electrode 270 this time having a planar shape may be formed on the entire surface of the insulation substrate 110 as a whole plate. The common electrode 270 may have an opening 275 formed in a region corresponding to the contact hole 185*a*. An edge of the opening 275 may surround the contact hole 185*a*.

A third passivation layer 180*c* may be positioned on the common electrode 270. The third passivation layer 180*c* may include a contact hole 185*a* exposing the extension 177 of the drain electrode 175 together with the first passivation layer 180*a*. The contact hole 185*a* is positioned in the opening 275 of the common electrode 270.

The pixel electrode 191 may be positioned on the third passivation layer 180*c*. The pixel electrode 191 may include a plurality of spaced apart branch electrodes 192 overlapping the common electrode 270, and a protrusion 193 for connection with other layers. A slit 92 in which an electrode is removed is formed between the adjacent branch electrodes 192 of the pixel electrode 191. The protrusion 193 of the pixel electrode 191 is physically and electrically connected with the drain electrode 175 through the contact hole 185*a* of the first passivation layer 180*a* and the third passivation layer 180*c* to receive a data voltage from the drain electrode 175.

Referring to FIG. 10, the light blocking member 220 may be positioned on the pixel electrode 191. However, the light blocking member 220 may be positioned on the upper panel 200 as illustrated in FIG. 11. In this case, the color filter 230 may also be positioned on the upper panel 200.

Next, a structure of a gate line driver of a display device according to an exemplary embodiment will be described with reference to FIGS. 12 to 15 together with the drawings described above.

Figure 12:
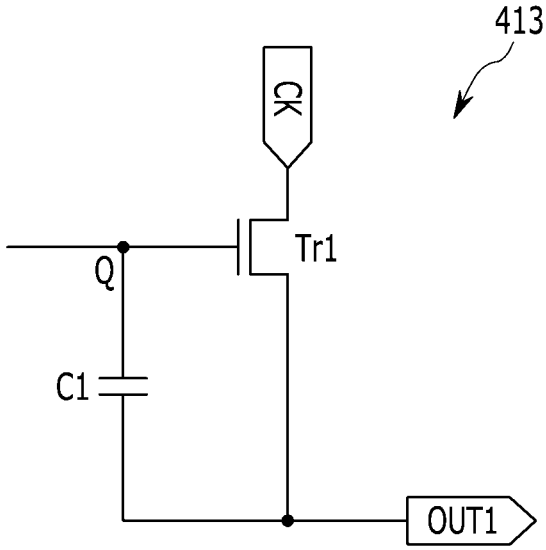
FIG. 12 is a circuit diagram of a transistor and a boost capacitor (C1) connected with the transistor as included for example in the gate lines driver of a display device configured according to the present disclosure of invention.
Figure 13:
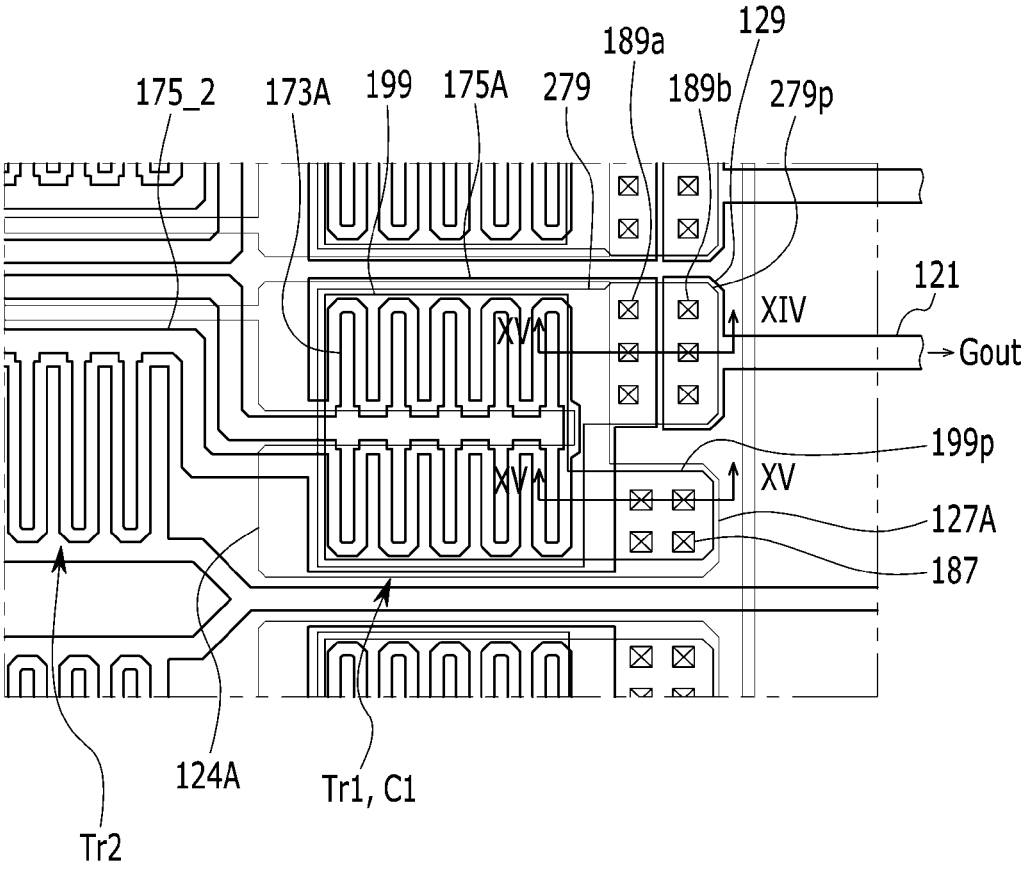
FIG. 13 is a top plan view layout diagram of the transistor and the boost capacitor connected with the transistor as included in the gate line driver stage of the display device according to the exemplary embodiment.
Figure 14:
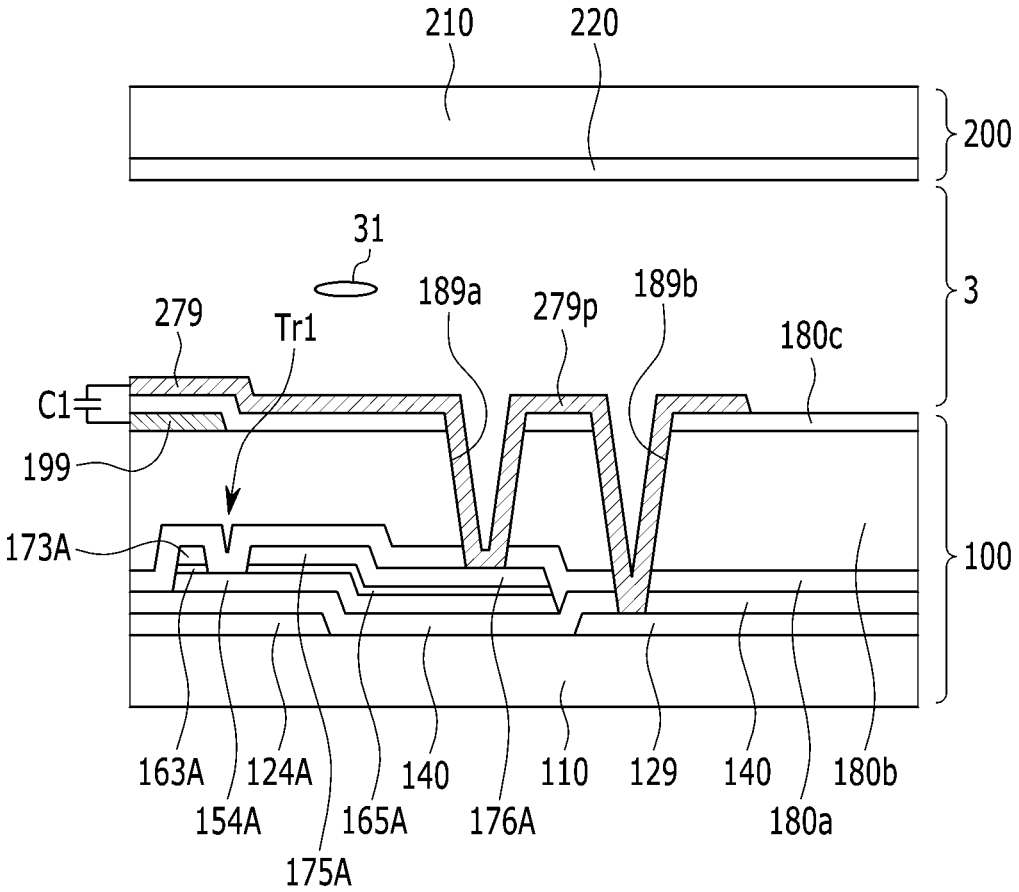
FIG. 14 is a cross-sectional view of the gate line driver of FIG. 13 taken along line XIV-XIV.

FIG. 12 is a circuit diagram of a transistor and a capacitor connected with the transistor as included in the gate lines driver of the display device according to the exemplary embodiments described above. FIG. 13 is an exemplary layout diagram of the transistor and the capacitor of FIG. 12 which are included in the gate line driver of the display device according to the exemplary embodiment. FIG. 14 is a cross-sectional view of the gate line driver of FIG. 13 taken along line XIV-XIV, and FIG. 15 is a cross-sectional view of the gate line driver of FIG. 13 taken along line XV-XV.

Referring to FIG. 12, a gate line driver of the display device according to the exemplary embodiment is almost the same as the exemplary embodiment described above, and includes a first transistor Tr1 and a boost capacitor C1 which are both connected between a first output terminal OUT1 and the Q node. Additionally, the first transistor Tr1 is further connected to the clock terminal CK. More specifically, one terminal of the capacitor C1 is connected with a control (gate) terminal of the first transistor Tr1, that is, a node Q, and the other terminal is connected with an output (source) terminal of the first transistor Tr1. The capacitor C1 of the first transistor Tr1 may be part of the driver pull-up portion 413 described above. The illustrated circuit is a source-follower configuration in which the clock line (CK) is providing drive power to the drain of first transistor Tr1 and the driven load is the capacitance of the gate line (OUT1) relative to a common voltage (Vcom). The driven load (not shown) is connected to the source terminal (OUT1) of the first transistor Tr1.

Figure 15:
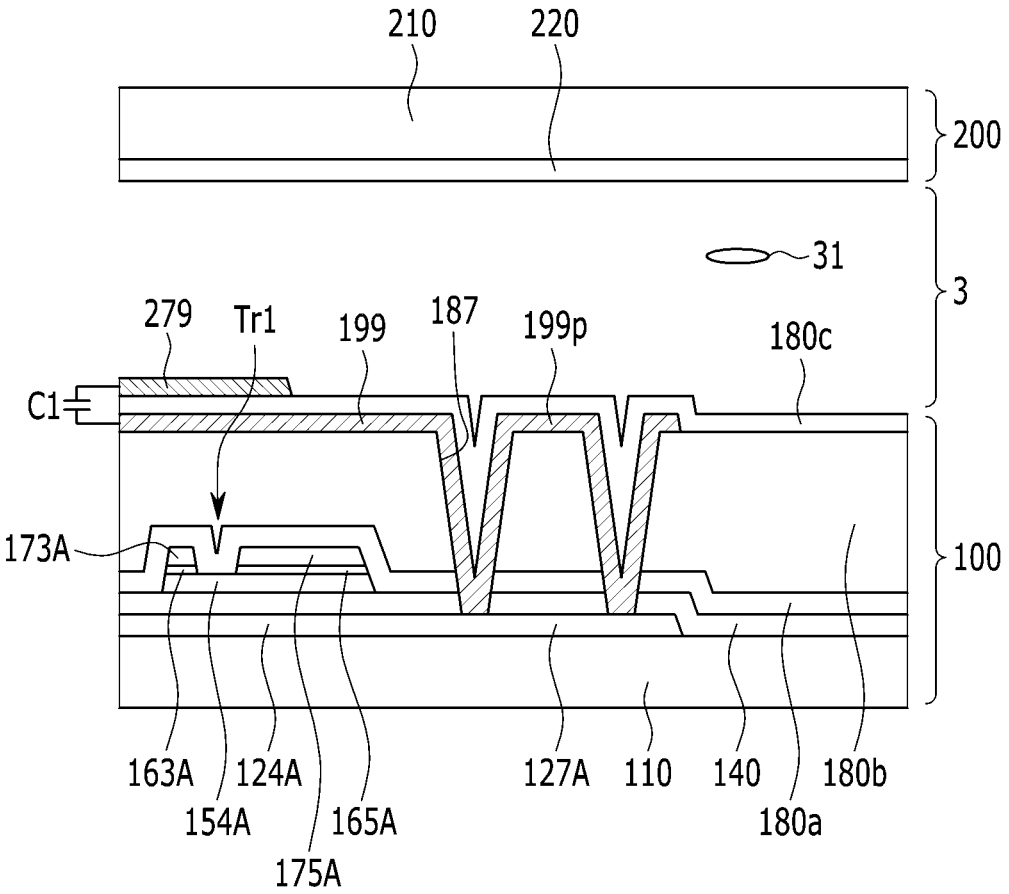
FIG. 15 is a cross-sectional view of the gate line driver of FIG. 13 taken along line XV-XV.

Referring to FIGS. 13 to 15, the display device according to the exemplary embodiment may be almost the same as the exemplary embodiment illustrated in FIGS. 6 to 11 described above, particularly, with respect to the pixel PX of the display area DA, and here, the structure of the gate line driver will be mainly described.

A gate layer conductor including a plurality of gate electrodes 124A is positioned on the insulation substrate 110. The gate conductor may be positioned at a same layer as the gate conductor of the exemplary embodiment described above.

The gate electrode 124A may include a protrusion 127A having surface area for connection with other layers.

The gate conductor may further include a plurality of gate lines 121. The gate lines 121 each includes an end portion 129 for connection with the gate lines driver, and the end portion 129 may be extended.

A gate insulating layer 140 is positioned on the gate conductor.

A semiconductive layer portion 154A is positioned on the gate insulating layer 140. The semiconductive layer portion 154A may include amorphous silicon, polysilicon, or a semiconductive oxide.

Ohmic contacts 163A and 165A may be positioned on the semiconductor 154A. The ohmic contacts 163A and 167A may be omitted.

A data layer conductor including a 'drain' electrode 173A and a 'source' electrode 175A is positioned on the ohmic contacts 163A and 165A and the gate insulating layer 140. The data layer conductor may be positioned at a same layer as the data line conductors of the exemplary embodiment described above.

The 'drain' electrode 173A may receive one of clock signals CLK and CLKB. The described circuitry is in a source-follower configuration in which the clock line (CK) is providing drive power to the 'drain' of first transistor Tr1 and the driven load is the capacitance of the gate line (OUT1) relative to a common voltage (Vcom). The driven load (not shown) is connected to the 'source' terminal (OUT1) of the first transistor Tr1.

The 'source' electrode 175A may include a protrusion 176A for connection with other layers. The 'source' electrode 175A may be connected with a second transistor Tr2, for example the one in block 416 of FIG. 5.

The gate electrode 124A, the 'drain' electrode 173A, and the 'source' electrode 175A form the first transistor Tr1 together with the semiconductive portion 154A. The gate electrode 124A forms a control terminal of the first transistor, the 'drain' electrode 173A forms an input terminal of the first transistor that receives drive power from the CK rail, and the 'source' electrode 175A forms an output terminal of the first transistor Tr1 that drives the capacitive load defined by the driven gate line (Gi) of the display area. A channel of the NMOS type first transistor Tr1 is formed in the semiconductive portion 154A and located between the 'drain' electrode 173A and the spaced apart 'source' electrode 175A.

A first passivation layer 180*a* is positioned on the data conductor, and a second passivation layer 180*b* is positioned thereon. When the second passivation layer 180*b* may include an inorganic insulating material or an organic insulating material as described above, and in the case of including the organic insulating material, a thickness of the second passivation layer 180*b* may be approximately 1.0 μm or more, and more particularly, approximately 2.0 μm or more, but is not limited thereto. Further, a dielectric constant of the second passivation layer 180*b* may be approximately 10 or less, and more particularly, approximately 3.3 or less, but is not limited thereto.

The first passivation layer 180*a* and the second passivation layer 180*b* may include a contact hole 189*a* exposing the protrusion 176A of the 'source' electrode 175A. The gate insulating layer 140, the first passivation layer 180*a*, and the second passivation layer 180*b* may include a contact hole 189*b* exposing the end portion 129 of the gate line 121, and a contact hole 187 exposing the protrusion 127A of the gate electrode 124A.

A first electrode 199 of the boost capacitor C1 is formed on the second passivation layer 180*b*. The first electrode 199 may include a protrusion area 199*p* for connection with other layers. The protrusion area 199*p* may be physically and electrically connected with the protrusion 127A of the gate electrode 124A through the contact hole 187 (FIG. 15).

The first electrode 199 may be positioned at the same layer as the pixel electrode 191 or the common electrode 270 described above.

A third passivation layer 180*c* is positioned on the first electrode 199. The third passivation layer 180*c* may have a thickness of between several hundred Å to several thousand Angstroms, for example, approximately 2,000 Å, but is not limited thereto. The third passivation layer 180*c* may define a dielectric layer of the boost capacitor (C1) as shall be described herein.

A second electrode 279 of the boost capacitor C1 is positioned on the thin third passivation layer 180*c*. The second electrode 279 may include a protrusion area 279*p* for connection with other layers. The protrusion area 279*p* of the second electrode 279 may be physically and electrically connected with the protrusion 176A of the 'source' electrode 175A through the contact hole 189*a* (FIG. 14). Further, the second electrode 279 may electrically connect the protrusion 176A of the 'source' electrode 175A and the end portion 129 of the gate line 121 through the contact holes 189*a* and 189*b*. The first transistor Tr1 may output a gate signal Gout to the terminal end 129 of the gate line 121 which is connected with the 'source' electrode 175A.

In the case where the first boost capacitor electrode 199 is positioned at the same layer as the pixel electrode 191 described above, the second boost capacitor electrode 279 may be positioned at the same layer as the common electrode 270, and in the case where the first electrode 199 is positioned at the same layer as the common electrode 270 described above, the second boost capacitor electrode 279 may be positioned at the same layer as the pixel electrode 191.

In the exemplary embodiment, an example in which the light blocking member 220 is positioned on the upper panel 200 is illustrated, but is not limited thereto.

The first boost capacitor electrode 199 and the second boost capacitor electrode 279 overlap each other in most of the region while having the thin third passivation layer 180*c* interposed therebetween as a dielectric. The first boost capacitor electrode 199 and the second boost capacitor electrode 279 form the capacitor C1 in which the third passivation layer 180*c* is formed as the dielectric material. Particularly, the first electrode 199 and the second electrode 279 are positioned in an area above at least one large output transistor (Tr1) included in the stage STi to overlap a region where that large area transistor is formed. In order to stably output the gate signal Gout, a relatively large capacitance of the capacitor C1 needs to be sufficiently ensured, and according to the exemplary embodiment, since the capacitor C1 is formed above the area of the wide area transistor (Tr1), a separate region for forming the large area capacitor C1 is not required to be allocated. Accordingly, this configuration reduces an integrated area consumed by the gate lines driver 400 while allowing the driver 400 to stably output its gate signals Gout. At the same time a relatively large capacitance of the capacitor C1 may also be sufficiently ensured. Accordingly, an area of the peripheral area PA of the display device may be reduced and an overall size of the display panel may be advantageously reduced.

More specifically, in one embodiment, the boost capacitor C1 is positioned, for example, above the closest first transistor Tr1 to overlap the first transistor Tr1, but is not limited thereto. That is, the capacitor C1 may overlap another large area transistor included in each stage STi of the gate driver 400.

According to the exemplary embodiment of the present disclosure of invention, the second passivation layer 180*b* is positioned between the capacitor C1 configured by the first electrode 199 and the second electrode 279 and the transistor therebelow to reduce a bias applied to the channel of the transistor. Particularly, in the case where the second passivation layer 180*b* includes an organic layer, a relative dielectric constant of the second passivation layer 180*b* may be kept low, for example approximately 10 or less (where air has a relative dielectric constant of one), and more particularly, approximately 3.3 or less as described above, and a thickness thereof may be approximately 1.0 μm or more, and more particularly, approximately 2.0 μm or more. As such, the thickness of the second passivation layer 180*b* is relatively increased, and the dielectric constant is relatively decreased to thereby prevent a characteristic of the transistor positioned below the capacitor C1 from deteriorating due to undesired capacitive coupling.

According to another exemplary embodiment of the present disclosure of invention, the laminating (stacking) positions of the first boost capacitor electrode 199 and the second boost capacitor electrode 279 forming the capacitor C1 may be changed (swapped).

The structure of the gate driver of the display device will be described with reference to FIGS. 16 and 17 in addition to FIG. 13 described above.

Figure 16:
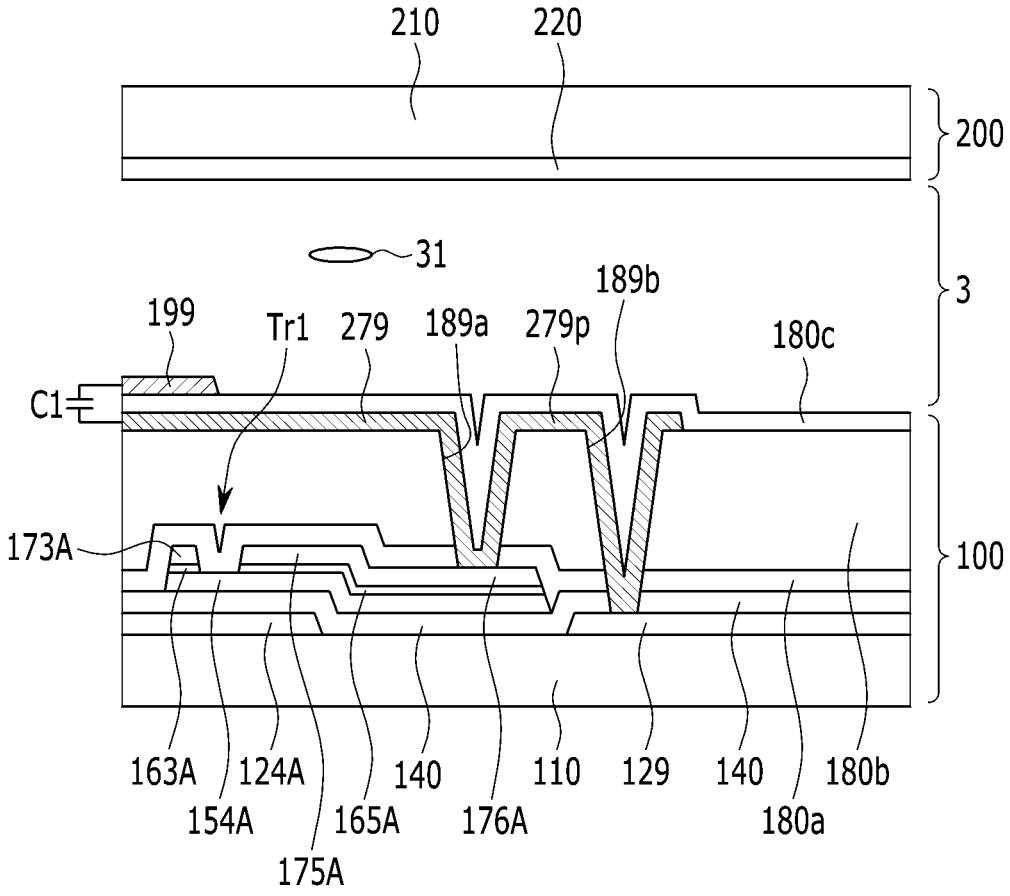
FIG. 16 is a cross-sectional view of an alternate gate line driver of FIG. 13 taken along line XIV-XIV.
Figure 17:
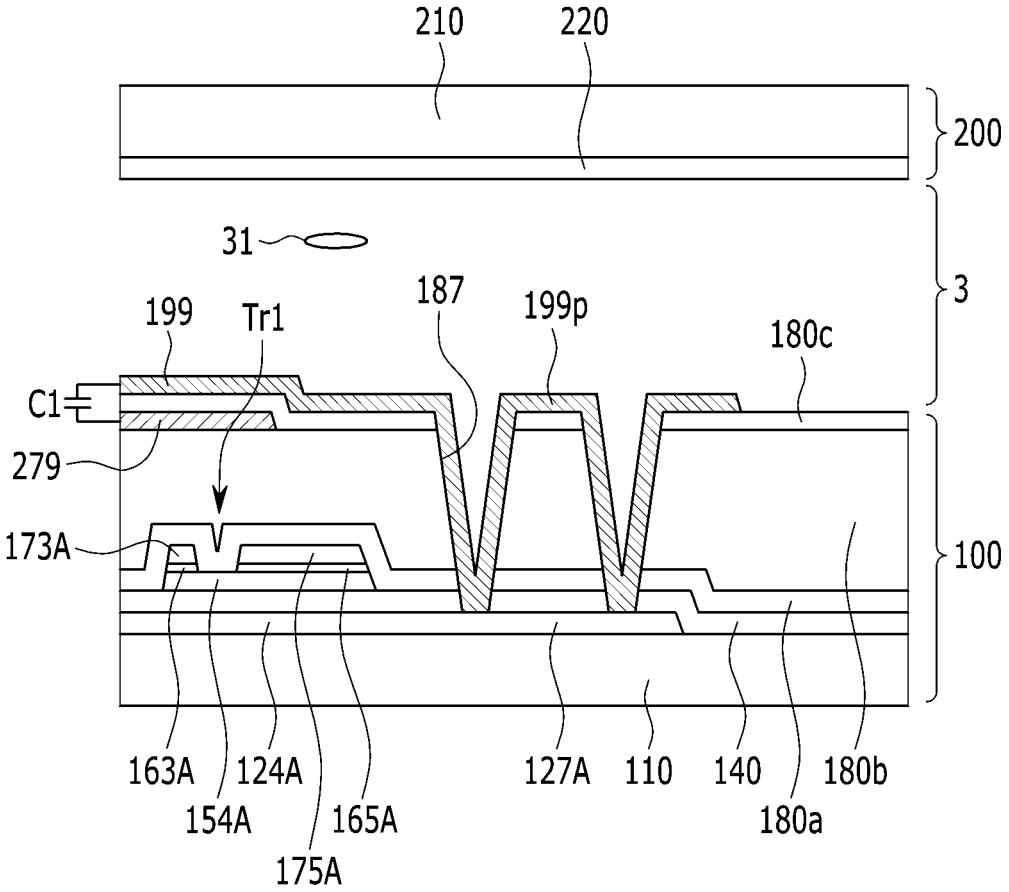
FIG. 17 is a cross-sectional view of an alternate gate line driver of FIG. 13 taken along line XV-XV.

FIG. 16 is a cross-sectional view of the gate driver of FIG. 13 taken along line XIV-XIV, and FIG. 17 is a cross-sectional view of the gate driver of FIG. 13 taken along line XV-XV.

Referring to FIGS. 16 and 17 in addition to FIG. 13, the gate driver of the display device according to the exemplary embodiment is almost the same as the exemplary embodiment illustrated in FIGS. 13 to 15 described above, but laminating (stacking) positions of the first electrode 199 and the second electrode 279 have been swapped (changed). That is, the second electrode 279, the third passivation layer 180*c*, and the first electrode 199 may be sequentially positioned on the second passivation layer 180*b*.

In addition, many features and effects of the exemplary embodiments described above may be equally applied to the exemplary embodiment.

While this disclosure of invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the present teachings.

What is claimed is:

1. A display device, comprising:

a display panel including a display area in which a plurality of pixel units are positioned on a light-passing substrate and in which a non-display peripheral area is also disposed on the substrate and adjacent to the display area; and a gate lines driver positioned on the substrate and in the peripheral area and including a transistor and a capacitor, wherein the capacitor is formed to overlap the transistor with a first insulating layer interposed between the transistor and the capacitor, each pixel unit respectively includes a respective switching element, a respective pixel electrode connected with the switching element, and a respective portion of a common electrode coupled to provide a common voltage, the pixel electrode and the common electrode portion are positioned above the first insulating layer, wherein the capacitor includes a first electrode and a second electrode which overlap each other with a second insulating layer interposed therebetween, the first electrode of the capacitor is positioned at a same layer as that of one of the pixel electrode and the common electrode portion, and the second electrode of the capacitor is positioned at a same layer as that of another of the pixel electrode and the common electrode portion.

2. The display device of claim 1, wherein:

the first insulating layer includes an organic insulating material.

3. The display device of claim 2, wherein:

the pixel electrode and the common electrode portion are stack, one overlapping the other and having the second insulating layer interposed therebetween.

4. The display device of claim 3, wherein:

the transistor includes a first gate electrode, a first drain electrode, and a first source electrode, the first electrode of the capacitor is connected with the first gate electrode, and the second electrode of the capacitor is connected with the first source electrode.

5. The display device of claim 4, wherein:

the first insulating layer includes a first contact hole exposing the first gate electrode and a second contact hole exposing the first source electrode, the first electrode of the capacitor is connected with the first gate electrode through the first contact hole, and the second electrode of the capacitor is connected with the first source electrode through the second contact hole.

6. The display device of claim 5, further comprising:

a gate line transferring a gate signal to the pixel, wherein the first insulating layer further includes a third contact hole exposing an end portion of the gate line, and the second electrode is connected with the end portion of the gate line through the third contact hole.

7. The display device of claim 6, wherein: a thickness of the first insulating layer is approximately 1.0 μm or more.

8. The display device of claim 7, wherein:

a dielectric constant of the first insulating layer is approximately 10 or less.

9. The display device of claim 1, wherein:

the pixel electrode and the common electrode overlap each other with the second insulating layer being interposed therebetween.

10. The display device of claim 9, wherein:

the first electrode of the capacitor is positioned at a same layer as that of the pixel electrode, and the second electrode of the capacitor is positioned at a same layer as that of the common electrode portion.

11. The display device of claim 9, wherein:

the first electrode of the capacitor is positioned at a same layer as that of the common electrode portion, and the second electrode of the capacitor is positioned at a same layer as that of the pixel electrode.

12. The display device of claim 9, wherein:

one of the pixel electrode and the common electrode portion includes a plurality of branch electrodes, and the other electrode overlaps the plurality of branch electrodes.

13. The display device of claim 1, wherein:

the transistor includes a first gate electrode, a first drain electrode, and a first source electrode, the first electrode of the capacitor is connected with the first gate electrode, and the second electrode of the capacitor is connected with the first source electrode.

14. The display device of claim 13, wherein:

the first insulating layer includes a first contact hole exposing the first gate electrode and a second contact hole exposing the first source electrode, the first electrode is connected with the first gate electrode through the first contact hole, and the second electrode is connected with the first source electrode through the second contact hole.

15. The display device of claim 14, further comprising:

a gate line transferring a gate signal to the pixel, wherein the first insulating layer further includes a third contact hole exposing an end portion of the gate line, and the second electrode is connected with the end portion of the gate line through the third contact hole.

16. The display device of claim 1, wherein:

a thickness of the first insulating layer is approximately 1.0 μm or more.

17. The display device of claim 16, wherein:

a dielectric constant of the first insulating layer is approximately 10 or less.

18. The display device of claim 1, further comprising:

a third insulating layer positioned between the first insulating layer and the transistor.

* * * * *